United States Patent [19]

Lee

[11] Patent Number: 4,669,033

[45] Date of Patent: May 26, 1987

[54] ADJUSTABLE OPTICAL REFLECTOR FOR FLUORESCENT FIXTURE

[75] Inventor: Richard H. Lee, San Francisco, Calif.

[73] Assignee: Specuflex, Inc., Oakland, Calif.

[21] Appl. No.: 777,913

[22] Filed: Sep. 19, 1985

[51] Int. Cl.[4] ..... F21V 7/16

[52] U.S. Cl. ..... 362/217; 362/346; 362/277; 362/319

[58] Field of Search ..... 362/346, 217, 220, 295, 362/297, 255, 260, 306, 347, 257, 277, 301, 306, 319, 320, 341, 346, 347, 349, 366, 408, 433

[56] References Cited

U.S. PATENT DOCUMENTS

| | | | |
|---|---|---|---|
| 2,368,810 | 2/1945 | Donnelly | 362/346 |
| 3,125,301 | 3/1964 | Stotter | 362/217 |
| 3,246,138 | 4/1966 | Florence | 362/217 |
| 4,388,675 | 6/1983 | Lewin | 362/247 |
| 4,599,684 | 7/1986 | Lee | 362/217 |

FOREIGN PATENT DOCUMENTS

| | | | |
|---|---|---|---|
| 1576997 | 8/1969 | France | 362/346 |
| 169489 | 8/1934 | Switzerland | 362/217 |

*Primary Examiner*—Charles J. Myhre
*Assistant Examiner*—D. M. Cox
*Attorney, Agent, or Firm*—Harris Zimmerman; Howard Cohen

[57] ABSTRACT

An adjustable specular reflector adapted for use in existing fluorescent lighting fixtures includes a plurality of facets extending longitudinally and hingedly joined together. The reflector may be formed of a form-retaining cardboard web having a highly reflective material adhered to one side, with longitudinal score lines defining the hinge portions between adjacent facets. A malleable wire or strip is secured to each end of the web, so that the facets may be oriented in a desired focussing relationship and will remain in the field-configured orientation. A rigid channel member is secured to opposed, longitudinally extending edges of the web to maintain planarity of the reflector facets. Self-adhesive patches are secured to the non-reflector side of the web, so that the reflector may be installed in virtually any fluorescent fixture.

12 Claims, 11 Drawing Figures

ADJUSTABLE OPTICAL REFLECTOR FOR FLUORESCENT FIXTURE

BACKGROUND OF THE INVENTION

In the past forty years fluorescent lighting has been the illumination of choice in constructing new buildings and spaces for retail, commercial, and office construction. As a general rule, fluorescent lighting has been arranged so that the illumination at floor level is uniform and bright. In an era of inexpensive electricity, this basic design parameter was sensible, especially in view of the fact that the final layout of office desks, retail counters, and the like could not be predicted by the building designer or electrical contractor.

However, in the last decade the increasing cost of electricity has significantly changed the design approach to lighting. It is now much more desirable to reduce the consumption of electicity, not only for the direct reduction of utility costs, but also to reduce air conditioning loads caused by secondary generation of heat in lighting fixtures. As lighting becomes more precious, it is clearly desirable to deliver bright illumination only to those areas where it is required, and to provide low level illumination elsewhere.

The problem for a great many owners and operators of building space is how to reduce electricity consumption for lighting, while providing illumination sufficient for the activities being carried out, without incurring prohibitive costs. One strategy involves removing every other fluorescent tube, and adding either desk lamps or movable track lighting to provide sufficient task illumination. However, the added fixture expense, together with the relative inefficiency of the incandescent lamps in the new fixtures results in little savings. Complete replacement of the existing fluorescent fixtures is another alternative, although the cost of this approach is generally very high.

A recent innovation is retrofit optical reflectors, adapted to be installed in existing fluorescent fixtures. These reflectors are designed to focus the fluorescent illumination on the task areas below the fixtures, so that either some fixtures may be eliminated, or some fluorescent tubes may be removed. These reflectors are generally made of formed sheet metal, much like the fixtures in which they are to be installed. They are not adapted to be altered in the field to focus the light onto specific task areas. Thus, although these prior art devices may increase illumination intensity by 30% directly below the fixtures, they cannot direct the illumination to the locations where it is actually required. Moreover, each of the many fluroescent fixture manufacturers have developed their own fixture designs and dimensions; each type of fixture requires a unique retrofit reflector. In a single building or installation, there may be many differing types of fixtures, each requiring a different type of retrofit reflector.

SUMMARY OF THE PRESENT INVENTION

The present invention generally comprises an optical reflector adapted to be used in existing fluorescent fixtures. A significant feature of the invention is that the reflector is designed to be adjusted during installation so that the fixture focus may be directed to the actual task area associated with the fixture. Another salient aspect of the invention is that the reflector may be installed in virtually any fluorescent fixture of any manufacturer, and is thus a generic solution to the prior art problem of reducing fluorescent lighting costs.

The adjustable specular reflector adapted for use in existing fluorescent lighting fixtures includes a plurality of facets extending longitudinally and hingedly joined together. The reflector may be formed of a form-retaining cardboard web having a highly reflective material adhered to one side, such as aluminized Mylar of the like. Longitudinal score lines in the web define adjacent reflector facets and form the linear hinge portions therebetween. A deformable yet form-retaining wire or strip is secured to the end portion at each end of the web, so that the facets may be oriented in a desired focussing relationship and will remain in that field-configured orientation.

A rigid channel member is secured to opposed, longitudinally extending edges of the web to maintain planarity of the reflector facets. Self-adhesive patches are secured to the non-reflector side of the web, so that the reflector may be adhered within a fixture without recourse to any tools. The self-adhesive patches eliminate any critical interfit dimensional tolerances, so that the reflector may be installed in virtually any fluorescent fixture.

DESCRIPTION OF THE PREFERRED EMBODIMENT

Figure 11:
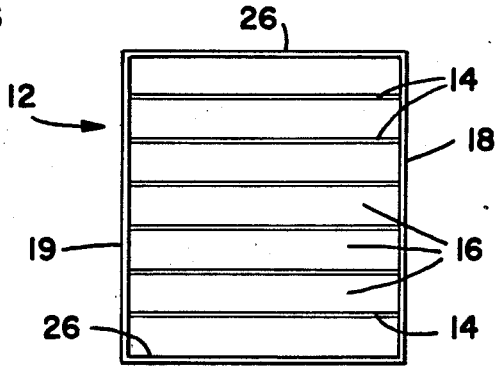
FIG. 11 is a plan layout of the adjustable fluorescent reflector of the present invention.
Figure 5:
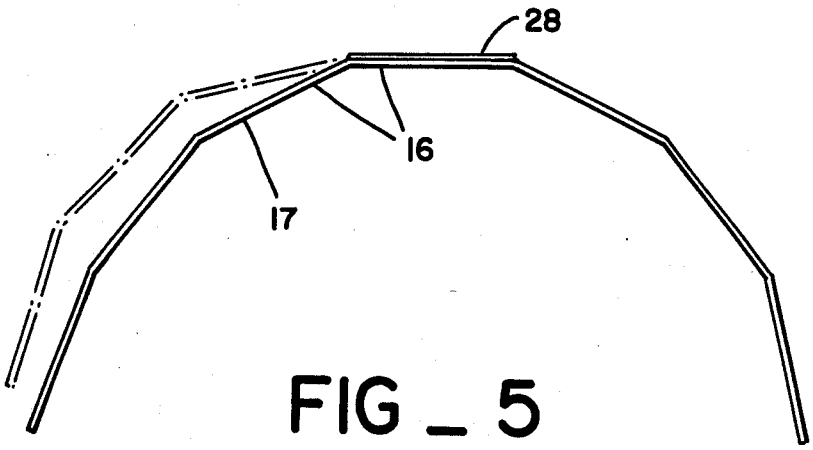
FIG. 5 is an end view of the reflector of the present invention, showing the adjustable angular relationships between facets thereof.
Figure 6:
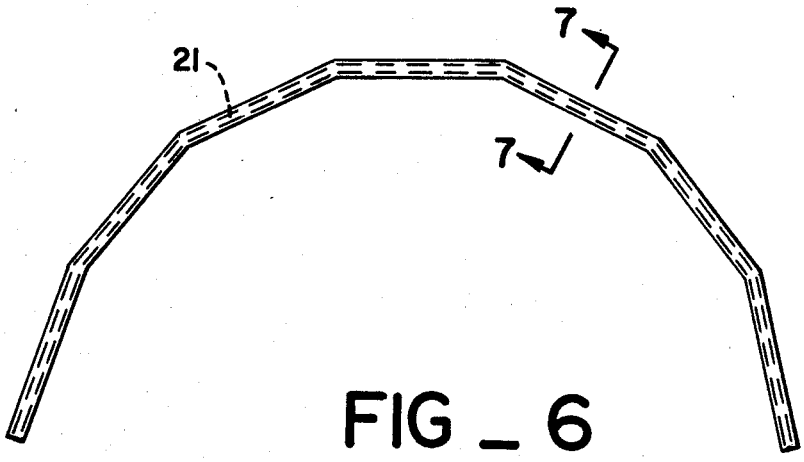
FIG. 6 is an end elevation of the reflector of the present invention.

The present invention generally comprises an adjustable specular reflector adapted to be installed in fluorescent lighting fixtures. The reflector is designed for retrofit in a wide variety of previously installed fixtures, as well as for use in newly manufactured fixtures. With regard to FIGS. 1, 5, 6, and 11, the reflector 12 of the present invention is formed of a rectangular web 13 of stiff, generally form-retaining material such as thick cardboard, plastic, or the like. A plurality of longitudinally extending facets 16 are defined in the web 13 by a plurality of parallel, longitudinally extending fold lines or score lines 14 formed by a standard die process known in the paper and packaging prior art. The lines 14 not only define the contiguous, adjacent facets 16, they also form integral hinges between adjacent facets 16. The web 13 is thus disposed to be bent from the planar disposition of FIG. 11 to a concave configuration, as shown in FIGS. 1, 2, 5, and 6. The surface 17 of the web 13 which forms the interior surface of the concave configuration is provided with a highly reflective specular surface layer, such as aluminized Mylar or the like.

Figure 7:
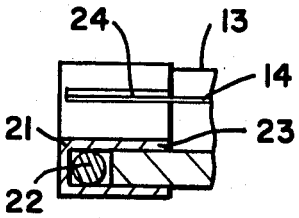
FIG. 7 is a partial cross-sectional elevation taken along line 7—7 of FIG. 6.

A significant feature of the present invention is that the web 13 may be arranged in virtually any desired concave configuration, and it will maintain that configuration thereafter until and unless the configuration is purposely altered by manual effort. With regard to FIGS. 6, 7,and 11, joined to the opposed end edges 18 and 19 of the web 13 is a pair of edge moldings or channels 21. The channels 21 are retained on the respective edge portions by crimping, and are permanently secured thereto. A wire or strip 22 is captured within the channel 21, and extends substantially the entire length of the respective edge 18 or 19. The member 22 is fashioned of a material that is deformable yet form retaining, such as a malleable metal or the like. Also, the wall 23 of the channel 22 which impinges on the outer surface of the web 13 is provided with relief die cuts 24 aligned with the hinge lines 14. As a result, the molding permits bending of the web 13 along the hinge lines 14 to create the concave reflector shape, and the member 22 has sufficient form-retaining ability to maintain that shape.

Figure 8:
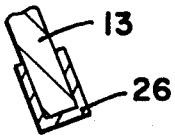
FIG. 8 is a partial cross-sectional elevation taken along line 8—8 of FIG. 1.

The web 13 also includes a pair of channel members 26 secured to the opposed, longitudinally extending edges thereof, as shown in FIG. 8. The members 26 provide added stiffness to the longitudinal edges. It may be appreciated that the hinge lines 14, because of their linear nature, tend to define facets 16 which are planar. The channels 26 assure that the opposed longitudinal edges are also linear, so that the outer facets are maintained in a planar configuration. With regard to both types of channel members 21 and 26, U-shaped channels have been shown for purpose of example only. Other types of channel configurations known in the prior art, such as "L" channel or the like may also be included within the scope of the invention.

Figure 2:
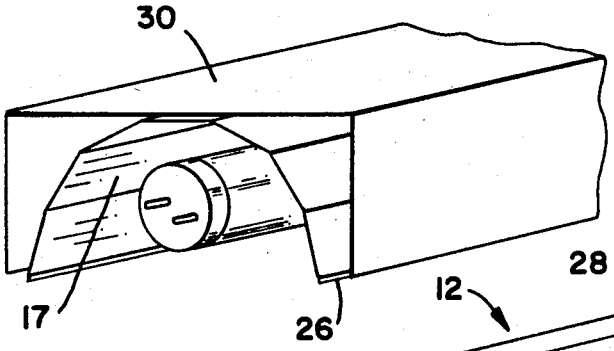
FIG. 2 is a perspective view of the reflector as in FIG. 1, shown installed in a representative fluorescent fixture.
Figure 1:
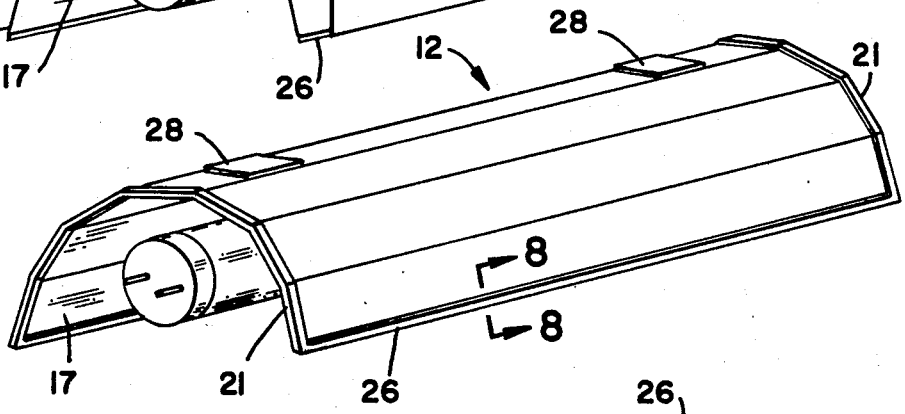
FIG. 1 is a perspective view of the focussing fluorescent reflector of the present invention.

The invention also includes a plurality of self-adhesive patches 28 secured to the outer surface of at least one of the facets 16, such as the medial facet, as shown in FIG. 1. The preferred form of patch 28 comprises a pressure-sensitive adhesive layer having a peelable release strip covering. Thus the reflector of the present invention may be formed to the desired concave shape, the release strips removed, and the reflector adhered to the inner surface of the fluorescent fixture 30, as shown in FIG. 2. A greater number of adhesive patches 28 may be provided, and may be secured to the outer surfaces of other facets 16, to permit securing the reflector to a large variety of fixtures.

It is significant to note that installation of the reflector of the present invention is not dependent upon any particular structural feature or dimension of the fluorescent fixture, so that the reflector is adapted to be used with virtually any fixture known in the prior art. Also, the reflector is installable without recourse to any tools, and without disassembly of any portion of the fixture. Due to the fact that lighting fixtures, by their very nature, are disposed in locations remote from casual impact or mechanical interference, the reflector will remain in place in the desired reflecting configuration. However, it is easy to remove the reflector when desired, or to reconfigure the shape of the reflector to redirect the illumination from the fixture, as is dictated by the nature of the activity or task below the fixture.

Figure 3:
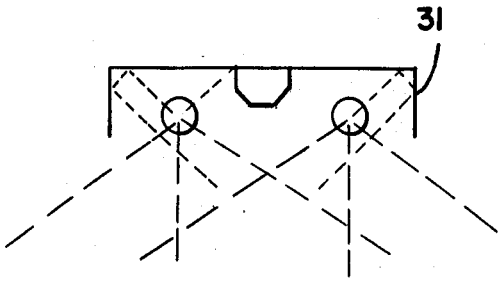
FIG 3 (PRIOR ART)
FIG. 3 is a simplified representation of a prior art fluorescent lighting fixture.
Figure 4:
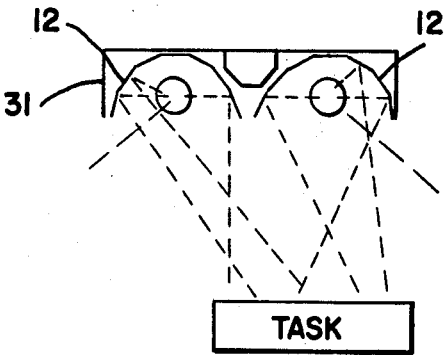
FIG. 4 is a simplified representation of the improvement in task lighting achieved with a fluorescent fixture fitted with the reflector of the present invention.

For example, FIG. 3 depicts a typical prior art fluorescent lighting fixture 31 which is designed to provide broad, dispersed, uniform illumination to the area therebelow. If the use of the area is later changed to a specific task, it is frequently necessary to redirect the uniform illumination to the task area, such as a desk, sales counter, manufacturing assembly area, or the like. In such case, a plurality of reflectors 12 of the present invention may be installed in the fixture 31, and individually configured by manually bending the reflectors and observing the focussing of the fluorescent lighting onto the task area. In this manner the lighting may be optimized for individual situations, whereas most prior art reflectors cannot be adjusted easily to accommodate differing focussing requirements.

It should also be noted that in some instances the focussing requirements for a number of reflectors 12 may be virtually identical. For example, an assembly line disposed adjacent to and offset from a line of fluroescent fixtures may require that all of the fixtures be altered to redirect the illumination at the same angle. In this case, it may be economical to fashion a jig for bending all of the reflectors 12 into the same concave configuration, rather than empirically altering each reflector to the optimum shape by trial and error.

Figure 9:
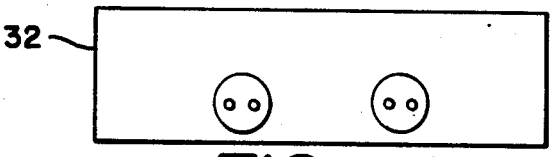
FIG 9 (PRIOR ART)
FIG. 9 is a simplified representation of a prior art fluorescent lighting fixture.
Figure 10:
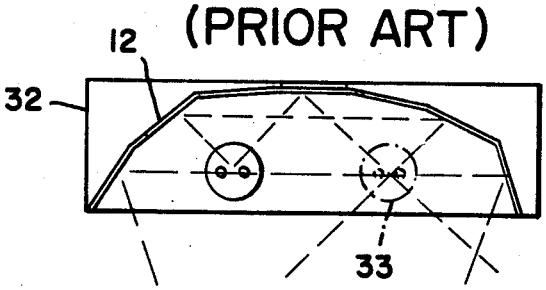
FIG. 10 is a simplified representation of a further use of the present invention, in which one fluorescent tube is removed and the reflector is used to provide uniform illumination from the remaining tube.

With regard to FIGS. 9 and 10, a further use of the present invention involves saving electrical energy used in lighting. A typical two tube fluroescent fixture 32 is shown in FIG. 9. It is often possible to reduce power consumption by removing one of the fluorescent tubes. However, the light from the remaining tube must be redirected to provide generally uniform illumination, or to direct the light to a specific task area. For the former purpose, a reflector 12 of the present invention may be installed in the fixture 32, after the tube 33 is removed. The reflector is shaped to direct the light from the remaining tube to an approximate line focus which corresponds to the position of the removed tube, thus creating a uniform illumination field.

It may be appreciated that the reflector of the present invention may be stored and shipped in a generally flat disposition, and configured in the field to form a concave reflector. This feature permits extremely compact and efficient packing of a plurality of the reflectors in a container, in vertically stacked fashion, resulting in easy handling and low shipping rates.

I claim:

1. An adjustable specular reflector, comprising; a plurality of planar facets in edge adjacent relationship, hinge means for joining each of said facets in pivotting fashion with respect to adjacent facets, said facets adapted to define together a contiguous, generally concave surface, a specular reflective layer adhered to said surface, means for maintaining said facets in selectively variable angular relationships, and a plurality of self-adhesive patches secured to the surface of said reflector opposed to said contiguous concave surface, said patches being disposed to be secured to the inner surface of an existing lighting fixture.

2. The reflector of claim 1, wherein said last mentioned means includes at least one deformable, form-retaining member joined to all of said facets.

3. The reflector of claim 2, further including a pair of said deformable, form-retaining members, each secured to opposed end portions of said reflector.

4. The reflector of claim 3, further including first channel means joined to said opposed end portions, said first channel means securing said deformable, form-retaining member thereto.

5. The reflector of claim 1, wherein said reflector is formed of a unitary web member, and said hinge means includes a plurality of fold lines formed in said web member.

6. The reflector of claim 5, wherein said fold lines extend longitudinally in said web member and are disposed in generally parallel relationship.

7. The reflector of claim 6, further including second channel means joined to opposed, longitudinally extending edge portions of said web member.

8. The reflector of claim 7, wherein said second channel means are sufficiently stiff to maintain linearity of said longitudinally extending edge portions.

9. The reflector of claim 8, further including first channel means joined to laterally extending edge portions of said web member, said first channel means including means to permit bending thereof at locations aligned with said fold lines in said web.

10. The reflector of claim 1, in which each of said facets define a generally rectangular planar configuration with adjacent longitudinally extending edge portions of adjacent facets being joined by said hinge means.

11. An optical reflector adapted for use in a lighting fixture, comprising; a web member formed of generally stiff material, one surface of said web having a specular reflective layer adhered thereto, a plurality of score lines formed in said web member to define a plurality of edge adjacent facets therein, said score lines defining hinge areas between adjacent facets to permit relative pivotal motion therebetween, said web member being configurable to a concave configuration with said specular reflective layer interior thereto, a plurality of deformable, form-retaining members secured to all of said facets and disposed to maintain said facets in selectively variable angular relationships, channel means joined to longitudinally extending edge portions of said web member and having sufficient stiffness to maintain a linear configuration thereof, and a plurality of self-adhesive patches joined to the other surface of said web member and disposed to adhere said reflector within a lighting fixture.

12. An optical reflector adapted for use in a lighting fixture, comprising; a web member formed of generally stiff material, one surface of said web having a specular reflective layer adhered thereto, a plurality of score lines formed in said web member to define a plurality of edge adjacent facets therein, said score lines defining hinge areas between adjacent facets to permit relative, freely pivotting motion therebetween, said web member being configurable to a concave configuration with said specular reflective layer interior thereto, means for maintaining said facets in selectively variable angular relationships, and mounting means disposed to secure said reflector within a lighting fixture.

* * * * *